US010183322B2

(12) United States Patent
Yamashita et al.

(10) Patent No.: US 10,183,322 B2
(45) Date of Patent: Jan. 22, 2019

(54) METHOD OF REUSING CORE SAND

(71) Applicant: TOYOTA JIDOSHA KABUSHIKI KAISHA, Toyota-shi, Aichi-ken (JP)

(72) Inventors: Daisuke Yamashita, Toyota (JP); Hirotsune Watanabe, Miyoshi (JP); Masashi Morikawa, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/287,479

(22) Filed: Oct. 6, 2016

(65) Prior Publication Data

US 2017/0106433 A1 Apr. 20, 2017

(30) Foreign Application Priority Data

Oct. 19, 2015 (JP) ..... 2015-205849

(51) Int. Cl.
*B22C 5/04* (2006.01)
*B22C 5/10* (2006.01)
*B22C 1/18* (2006.01)

(52) U.S. Cl.
CPC ..... *B22C 5/04* (2013.01); *B22C 1/188* (2013.01); *B22C 5/10* (2013.01)

(58) Field of Classification Search
CPC .... B22C 5/04; B22C 5/10; B22C 5/18; B22C 5/185
USPC ..... 164/5
See application file for complete search history.

(56) References Cited

U.S. PATENT DOCUMENTS 4,491,277 A * 1/1985 Bauer ..... B22C 5/18 241/5
5,045,090 A * 9/1991 Pohl ..... B22C 5/044 134/2
2010/0173767 A1* 7/2010 Koch ..... B22C 5/085 501/128
2014/0166226 A1* 6/2014 Schwickal ..... B22C 5/04 164/5
2014/0284015 A1 9/2014 Mitsutake et al.

FOREIGN PATENT DOCUMENTS

DE 1806842 A1 * 5/1970 ..... B22C 5/18
JP 2006-247699 A 9/2006
JP 2010-519042 A 6/2010
JP 2013-111602 A 6/2013

OTHER PUBLICATIONS

EPO machine translation of DE-1806842-A1 (Year: 1970).*
U.S. Appl. No. 15/949,394 (Daisuke Yamashita et al.), filed Apr. 10, 2018.

* cited by examiner

*Primary Examiner* — Kevin E Yoon
(74) *Attorney, Agent, or Firm* — Oliff PLC

(57) ABSTRACT

A method of reusing core sand includes: crushing a core used for casting into granules; heating the granules at a temperature of 300° C. to 550° C.; causing the heated granules to collide against each other such that water glass used as a binder detaches from the core sand; and blowing air into a mixture of the water glass and the core sand, which are detached from each other, such that the core sand is separated and collected from the mixture due to a difference in specific gravity between the water glass and the core sand.

6 Claims, 11 Drawing Sheets

METHOD OF REUSING CORE SAND

INCORPORATION BY REFERENCE

The disclosure of Japanese Patent Application No. 2015-205849 filed on Oct. 19, 2015 including the specification, drawings and abstract is incorporated herein by reference in its entirety.

BACKGROUND

1. Field of the Disclosure

The present disclosure relates to a method of reusing core sand, for example, a method of reusing core sand in which water glass is used as a binder.

2. Description of Related Art

Japanese Patent Application Publication No. 2013-111602 (JP 2013-111602 A) discloses a method for forming a sand mold (core) in which water glass is used as a binder to prevent the production of gas from a core during casting.

SUMMARY

In general, sand (core sand) for forming a core is reused. During the formation of a core for casting, core sand is mixed with a binder in order to make core sand grains adhere to each other. The core sand can be reused by collecting the core sand, which is not needed after casting, and removing impurities and the binder adhering to the core sand from the core sand.

However, regarding a core in which water glass is used as a binder, it is difficult to separate the core into core sand and water glass. In a case where a sand mold (core) is formed using core sand in which water glass remains, it is difficult to harden the core sand so as to have a sufficient strength. Therefore, a method of reusing core sand in which water glass is used as a binder has yet to be established.

The disclosure provides a method of reusing core sand capable of improving the strength of a core which is formed by reusing core sand in which water glass is used as a binder.

According to an aspect of the disclosure, there is provided a method of reusing core sand including: crushing a core used for casting into granules; heating the granules at a temperature of 300° C. to 550° C.; causing the heated granules to collide against each other such that water glass used as a binder detaches from the core sand; and blowing air into a mixture of the water glass and the core sand, which are detached from each other, such that the core sand is separated and collected from the mixture due to a difference in specific gravity between the water glass and the core sand.

According to the aspect, the granules obtained by crushing the core after casting are heated at a temperature of 300° C. to 550° C. Therefore, the water glass included in the granules is inactivated (modified so as not to inhibit the hardening of water glass during reuse), and the strength of a core formed reusing the core sand can be improved.

According to the aspect of the disclosure, the strength of a core, which is formed by reusing core sand in which water glass is used as a binder, can be improved.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, an embodiment of the disclosure will be described in detail with reference to the accompanying drawings. However, the disclosure is not limited to the following embodiment. In order to clarify the description, the following description and the drawings are appropriately simplified.

A method of reusing core sand according to the embodiment will be described. In the method of reusing core sand according to the embodiment, water glass is used as a binder. That is, in this method, core sand in which water glass is used as a binder is reused after forming a core using the core sand and using the core for aluminum casting at a casting temperature of 650° C. to 750° C.

Here, first, a mechanism in which the water glass used as the binder during the formation of the core is hardened will be described. Next, a mechanism in which water glass which has been used as a binder inhibits the hardening of water glass newly added as a binder will be described. Next, the method of reusing core sand in which water glass is used as a binder will be described.

Figure 1A:
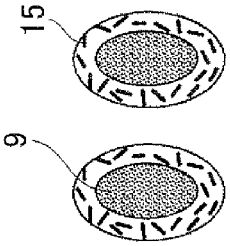
FIG. 1A is a diagram showing a mechanism according to an embodiment of the disclosure in which water glass is hardened.
Figure 1B:
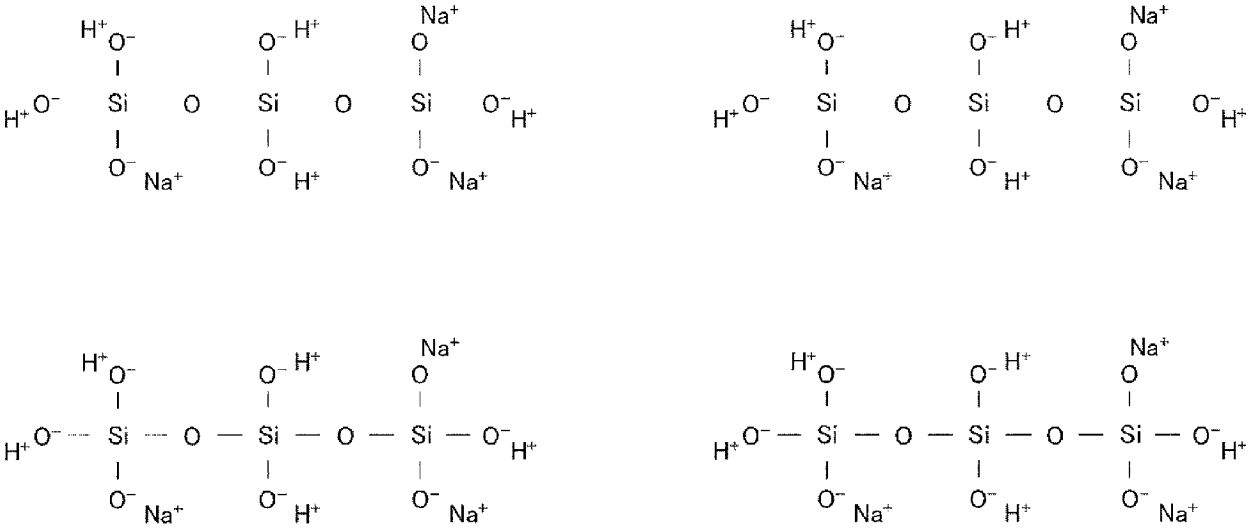
FIG. 1B is a diagram showing the mechanism according to the embodiment of the disclosure in which water glass is hardened.

FIGS. 1A to 3B are diagrams showing the mechanism in which water glass is hardened. During the formation of a core, water and water glass 15 as a binder are mixed with core sand 9, and the mixture is kneaded. As shown in FIG. 1A, the water glass 15 adhering to a surface of the core sand 9 is represented by the following molecular formula (1) and has a structure represented by the following formula (2). As shown in the formula (1), the water glass 15 is a mixture including silicon dioxide, sodium oxide, and water. As shown in the formula (2), an OH group is present at a molecular terminal of the water glass 15.

$$SiO_2 \cdot nNa_2O \cdot mH_2O \tag{1}$$

(2)

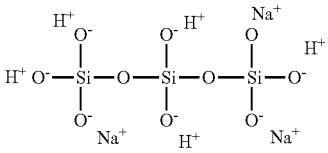

Figure 2:
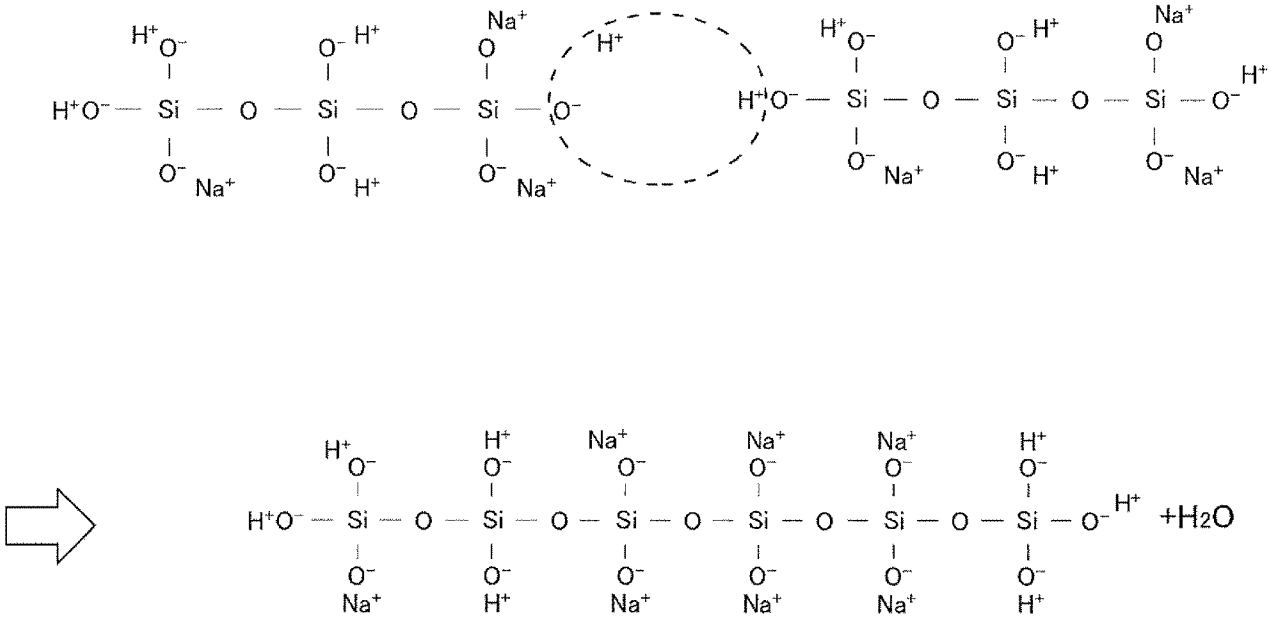
FIG. 2 is a diagram showing the mechanism according to the embodiment of the disclosure in which water glass is hardened.

Next, the kneaded mixture of the core sand 9, water, and the water glass 15 is put into a mold and fixed. As shown in FIG. 2, for example, during the formation of a core or casting, the water glass 15 is heated at a high temperature such that the molecules thereof react with and bind to each other. The OH group present at the molecular terminal of the water glass 15 causes a dehydration condensation reaction to occur. At this time, an O ion and a H ion in an OH group present at a terminal of one molecule react with and bind to a H ion in an OH group present at a terminal of another molecule to form one water molecule.

Figure 3A:
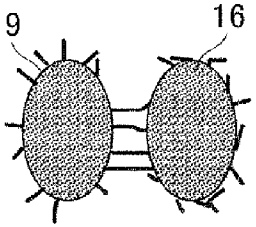
FIG. 3A is a diagram showing the mechanism according to the embodiment of the disclosure in which water glass is hardened.
Figure 3B:
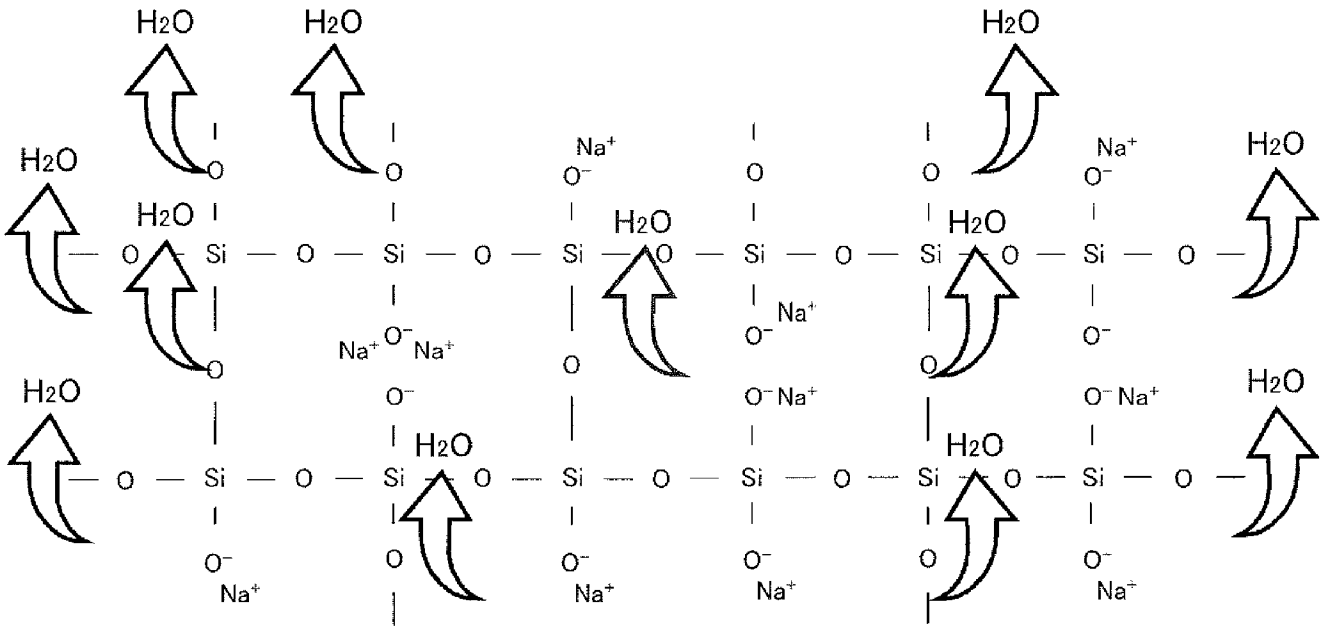
FIG. 3B is a diagram showing the mechanism according to the embodiment of the disclosure in which water glass is hardened.

As shown in FIGS. 3A and 3B, due to the above-described dehydration condensation reaction, the molecules of the water glass 15 adhering to the surface of the core sand 9 react with and bind to each other. A Si—O network 16 is formed on the surface of the core sand 9. As a result, a core including the water glass 15 is hardened. At this time, a large number of water molecules are formed. The water glass 15 is used as the binder during the formation of the core. The formed core has a sufficient strength.

Next, a mechanism in which the water glass 15 which has been used as a binder (hereinafter, referred to as "used water glass 15") inhibits the hardening of the water glass 15 newly added as a binder (hereinafter, referred to as "new water glass 15") will be described. Even when the core sand 9 is reused, water and the new water glass 15 are mixed with the care sand 9, and the mixture is kneaded. The core sand 9 includes the used water glass 15. The used water glass 15 loses its original adhesive force. Due to this reason, as described below, it is presumed that the used water glass 15 has sodium ions. When the core sand 9 including the used water glass 15, water, and the new water glass 15 are mixed with each other, the sodium ions are eluted from the used water glass 15 into water. The sodium ions eluted into water are substituted with hydrogen ions in the new water glass 15. The new water glass 15 has a structure represented by the following formula (3).

(3)

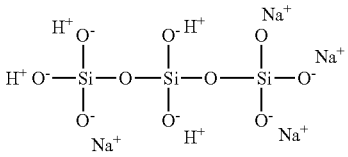

Figure 4:
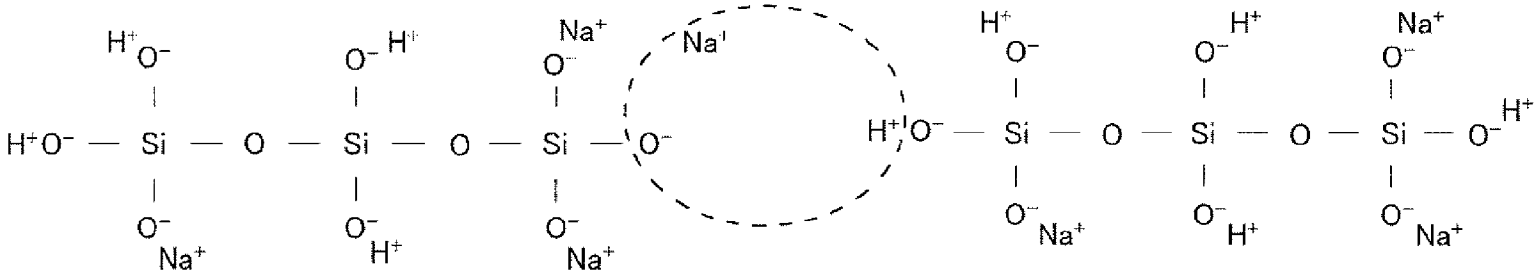
FIG. 4 is a diagram showing a mechanism according to the embodiment of the disclosure in which the hardening of water glass is inhibited by sodium.

FIG. 4 is a diagram showing a mechanism in which the hardening of water glass is inhibited by sodium. As shown in FIG. 4, when the water glass 15 has the structure represented by the above-described formula (3), the reaction caused by the hardening mechanism of the water glass 15 shown in FIG. 2 is not likely to progress. That is, the dehydration condensation reaction of the water glass 15 is prevented. Accordingly, the Si—O network 16 cannot be formed using the water glass 15 adhering to the surface of the core sand 9. Therefore, when the core sand 9 including the used water glass 15 is reused to form a core, the strength of the formed core cannot be maintained at a predetermined value. In this way, in the related art, a core having a strength equivalent to that of the new core sand 9 cannot be framed using the core sand 9 including the used water glass 15. In the method of reusing the core sand 9 described below, the core sand 9 including the used water glass 15 can be reused.

Figure 5:
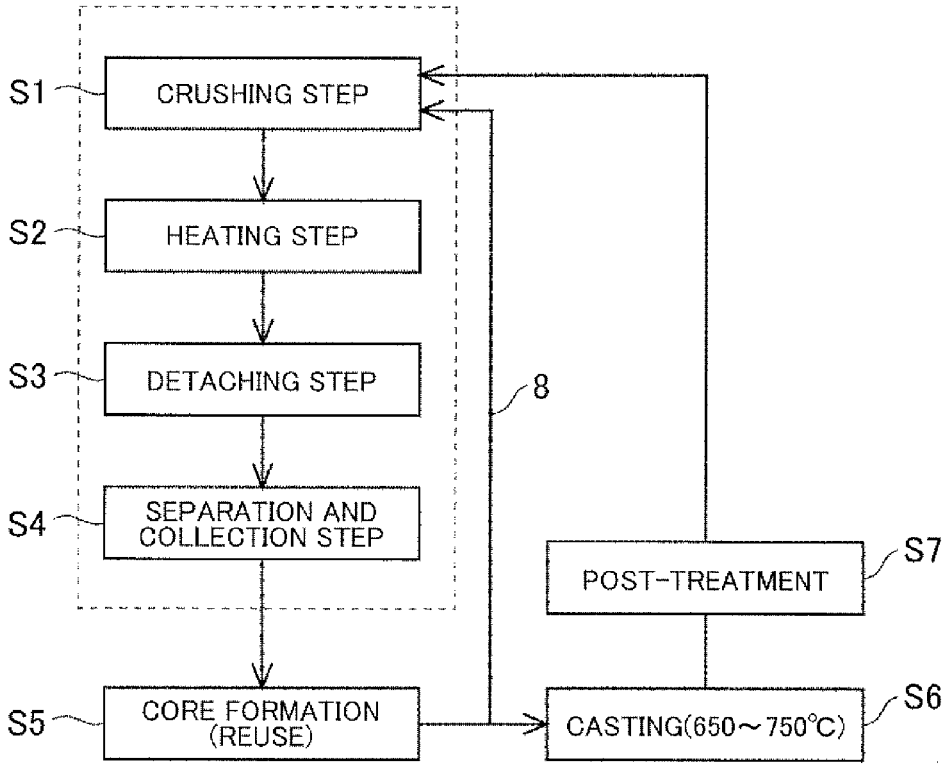
FIG. 5 is a flowchart showing an example of a method of reusing core sand according to the embodiment of the disclosure.

FIG. 5 is a flowchart showing an example of a method of reusing core sand according to the embodiment of the disclosure. As shown in FIG. 5, the method of reusing the core sand 9 according to the embodiment includes a crushing step (Step S1), a heating step (Step S2), a detaching step (Step S3), and a separation and collection step (Step S4). In the crushing step, a core used for casting is crushed into granules 14. For example, the core is crushed until the average grain size (D50) of the granules is 3 mm or less. The average grain size of the granules after crushing is not particularly limited as long as it is about 10 mm or less. However, the less the average grain size, the better. In a case where the core sand 9 is reused to form a core (Step S5), a defective core 8 which cannot be used for casting (Step S6) may be formed due to chipping or cracking. This defective core 8 is also crushed in the crushing step (Step S1).

Figure 6:
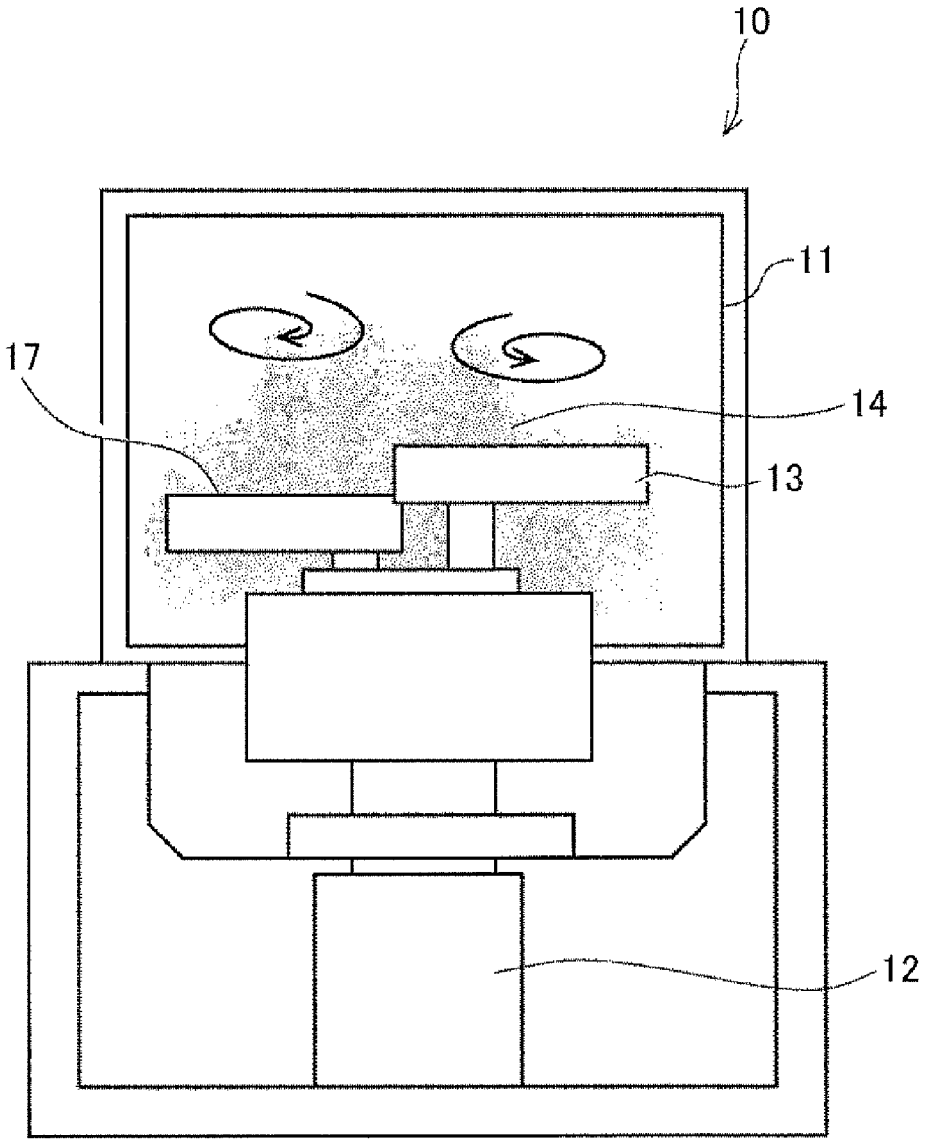
FIG. 6 is a diagram showing a crushing device which crushes core sand in the method of reusing core sand according to the embodiment of the disclosure.

In the crushing step, for example, a crushing device 10 is used. FIG. 6 is a diagram showing a crushing device which crushes core sand in the method of reusing core sand according to the embodiment of the disclosure. As shown in FIG. 6, the crushing device 10 includes a chamber 11, a motor, 12, a rotor 13, and a mesh 17. The chamber 11 is provided above the motor 12. The rotor 13 provide in the chamber 11 is connected to the motor 12. Due to the rotation of the motor 12, the rotor 13 swings. The mesh 17 is provided on a top surface of the rotor 13.

A lump of core is put into the chamber 11, and the rotor 13 swings due to the motor 12. Due to the swinging of the rotor 13, granules of the core collide against each other, or the rotor 13 collides against the core. As a result, the core is crushed. The granules 14 is sieved through the mesh 17 to have a grain size less than a pore size of the mesh 17. As a result, the core is crushed into the granules 14 having a grain size of 3 mm or less.

Figure 7:
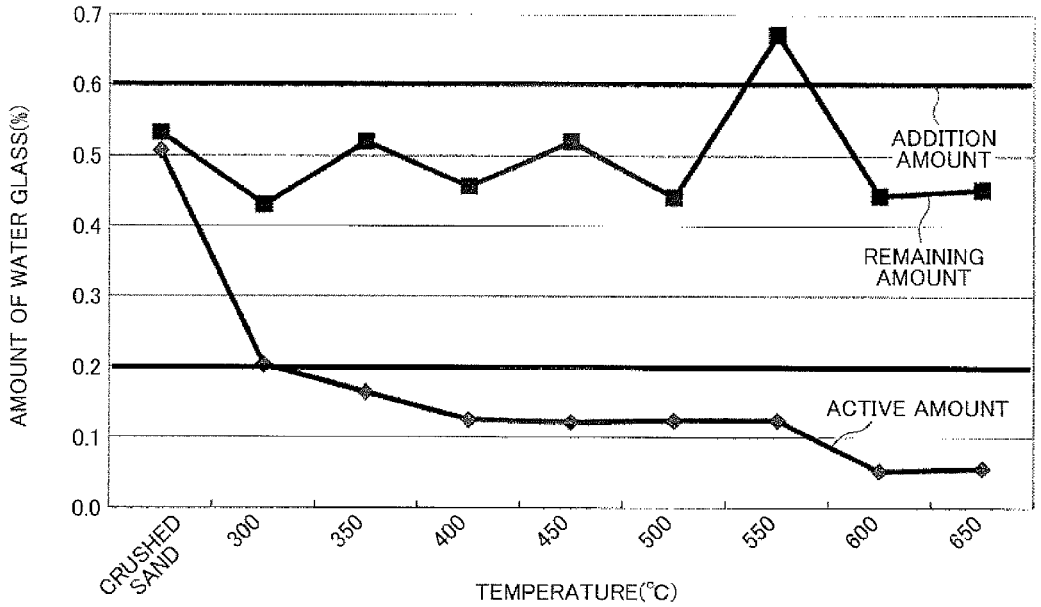
FIG. 7 is a graph showing the active amount and the total remaining amount of water glass which vary depending on a heating temperature in the method of reusing core sand according to the embodiment of the disclosure, in which the horizontal axis represents the heating temperature and the vertical axis represents a ratio of the mass of water glass to the mass of granules.

Next, in the heating step shown in Step S2 of FIG. 5, the granules 14 are heated at a temperature of 300° C. to 550° C. FIG. 7 is a graph showing the active amount and the remaining amount of the water glass 15 which vary depending on the heating temperature in the method of reusing core sand according to the embodiment, in which the horizontal axis represents the heating temperature and the vertical axis represents a ratio of the mass of the water glass 15 to the mass of the granules. The heating time at each temperature is 10 minutes or longer, for example, 10 minutes. Here, the remaining amount of the water glass 15 is obtained based on the amount of the water glass 15 which is eluted into an acid by dipping the core sand 9 in the acid. The water glass 15 is dissolved in an acid. Therefore, using this method, the remaining amount of the water glass 15 in the core sand 9 can be measured.

On the other hand, the active amount of the water glass 15 is obtained based on the amount of the water glass 15 eluted into water by dipping the core sand 9 in water. The active amount of the water glass 15 refers to the amount of active water glass 15. The active water glass 15 refers to water-soluble water glass 15. When dissolved in water, the water-soluble water glass 15 releases sodium ions. As described above, the sodium ions inhibit the hardening of the water glass 15 as a binder. Since the active water glass 15 is water-soluble, the active amount of the water glass 15 included in the core sand 9 can be measured.

As shown in FIG. 7, the amount of the water glass 15 added as a binder during the formation of the core is 0.6%. The amount of the water glass 15 added in a case where the new core sand 9 is used is the same as the amount of the water glass 15 added in a case where the core sand 9 after casting is reused. The reason is that the used water glass 15 loses its original adhesive force.

The remaining amount of the water glass 15 included in the core sand 9 after the crushing step is about 0.53%. The remaining amount includes the amount of the active water glass 15 (water-soluble water glass 15) and the amount of inactive water glass 15 (water-insoluble water glass 15). The active amount of the water glass 15 is about 0.51%. In this way, in a case where the core sand 9 includes the used water glass 15, most of the remaining water glass 15 is the active water glass 15.

In a case where the heating temperature is lower than 300° C., the active amount of the water glass 15 is larger than 0.20%. That is, in a case where the heating temperature is lower than 300° C., most of the water glass 15 remaining in the core sand 9 is the active water glass 15. In a case where the heating temperature is 300° C., the remaining amount of the water glass 15 is 0.43%, and the active amount thereof is 0.20%. Accordingly, the amount of the water-insoluble water glass 15 is 0.23%. In a case where the heating temperature is 350° C., the remaining amount of the water glass 15 is 0.52%, and the active amount thereof is 0.17% which is lower than 0.20%. Accordingly, the amount of the water-insoluble water glass 15 is 0.35%.

In a case where the heating temperatures are 400° C., 450° C., 500° C., and 550° C., the remaining amounts of the water glass 15 are 0.46%, 0.52%, 0.44%, and 0.67%, respectively. At all the heating temperatures, the active amounts are 0.12%, which is lower than 0.20%. Accordingly, the amounts of the water-insoluble water glass 15 are 0.34%, 0.40%, 0.32%, and 0.55%, respectively. In a case where the heating temperatures are 600° C. and 650° C., the remaining amounts of the water glass 15 are 0.44% and 0.45%. At all the heating temperatures, the active amounts are 0.06%, which are lower than 0.20%. Accordingly, the amounts of the water-insoluble water glass 15 are 0.38% and 0.39%, respectively.

By heating the granules 14 at a temperature of 300° C. or higher in the heating step, the amount of the water-soluble water glass 15 is adjusted to be smaller than the amount of the water-insoluble water glass 15 in the water glass 15 included in the granules 14. As a result, the inhibition of the hardening of the core sand 9 during reuse can be prevented.

As the amount of the water glass 15 eluted into water which is added during the formation of a core decreases, the strength of the formed core is improved. In a case where the core sand 9 is reused to form a core, the core has a predetermined strength only when the active amount of the water glass 15 included in the core sand 9 is 0.20% or lower. Accordingly, it is preferable that the heating temperature is 300° C. or higher in consideration of the active amount of the water glass 15 included in the core sand 9. In this way, in the heating step, the water glass 15 remaining in the core sand 9 is inactivated to obtain the water-insoluble water glass 15. Due to the heating, the amount of the water-soluble water glass 15 in the water glass 15 included in the granules is adjusted to be 0.2% or lower with respect to the amount of the granules. As a result, the strength of the core can be improved.

On the other hand, in a case where the heating temperature is higher than 550° C., the core sand 9 is solidified. The core sand 9 and the binder are solidified in the heating device, and thus the core sand 9 cannot be separated from the binder. Accordingly, it is preferable that the heating temperature in the heating step is 300° C. to 550° C.

Figure 8:
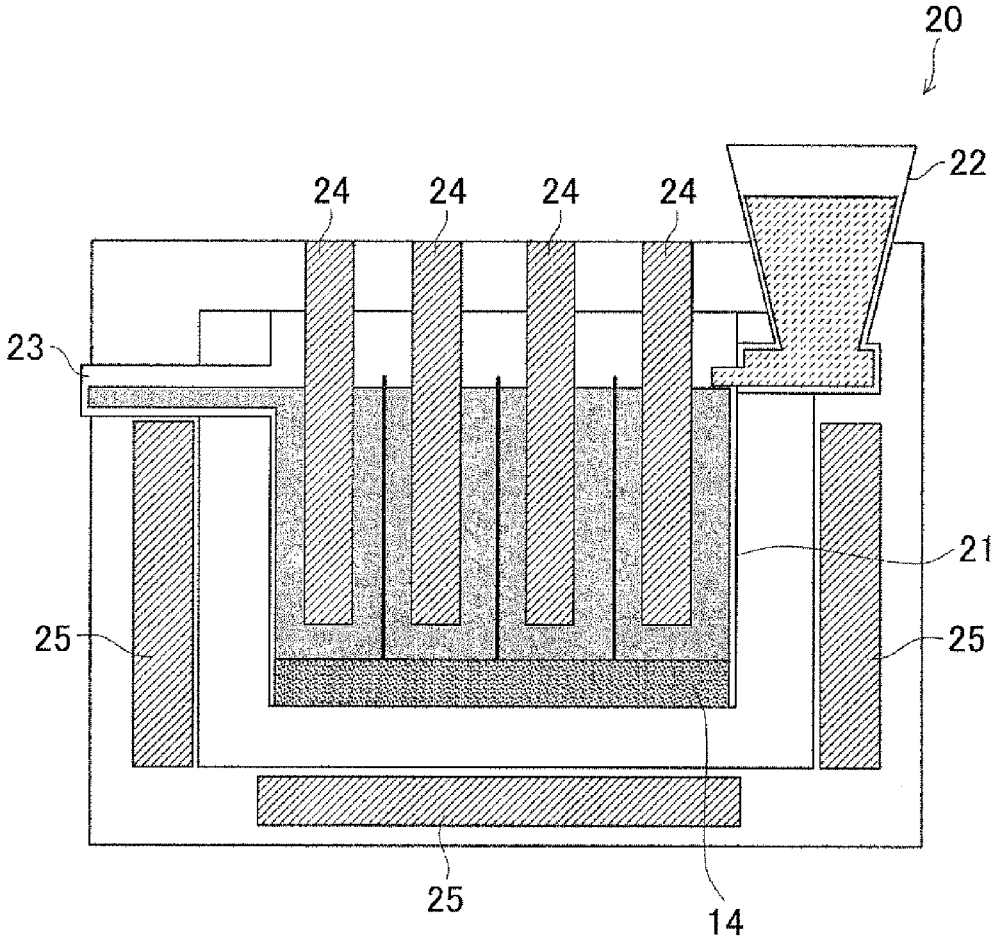
FIG. 8 is a diagram showing a heating device which heats the core sand in the method of reusing core sand according to the embodiment of the disclosure.

In the heating step, for example, a heating device 20 is used. FIG. 8 is a diagram showing the heating device which heats the core sand in the method of reusing core sand according to the embodiment. As shown in FIG. 8, the heating device 20 includes a fluid tank 21, an inlet 22, an outlet 23, tube heaters 24, and panel heaters 25. The fluid tank 21 has a tank shape. The inlet 22 is provided at an end of an upper region of the fluid tank 21. The outlet 23 is provided at another end of the upper region of the fluid tank 21.

The upper region of the fluid tank 21 is covered with, for example, an upper cover. The inside of the fluid tank 21 is divided by a partition so as to have a labyrinthine structure. For example, air flows through the inside of the fluid tank 21. As a result, a heating target in the fluid tank 21 flows from the inlet 22 to the outlet 23. The plural tube heaters 24 are inserted into the inside of the fluid tank 21 from above.

Each of the tube heaters 24 has a rod shape and has one end connected to a region of the fluid tank 21 near the bottom and the other end protruding from the upper cover of the fluid tank 21. The tube heaters 24 are disposed in the fluid tank 21 at regular intervals. The panel heaters 25 are provided on wall surfaces and the bottom surface of the fluid tank 21.

The core sand 9 as the granules 14 is put into the inlet 22 of the heating device 20. The granules 14 flow through the inside of the fluid tank 21, which is divided by the partition, along with flowing air. For example, air is caused to flow at a flow rate of 1100 L/min in the fluid tank 21. The granules 14 are uniformly heated by the tube heaters 24, which are disposed at regular intervals, and the panel heaters 25. Since the inside of the fluid tank 21 has a labyrinthine structure, the time during which the granules 14 remains in the fluid tank 21 is secured. Since the granules 14 flows along with air, the number of contacts between the granules 14 and impurities is reduced. After heating, the granules 14 is cooled to a polishing temperature of 100° C. or lower using an air-cooling heat exchange method.

Figure 9B:
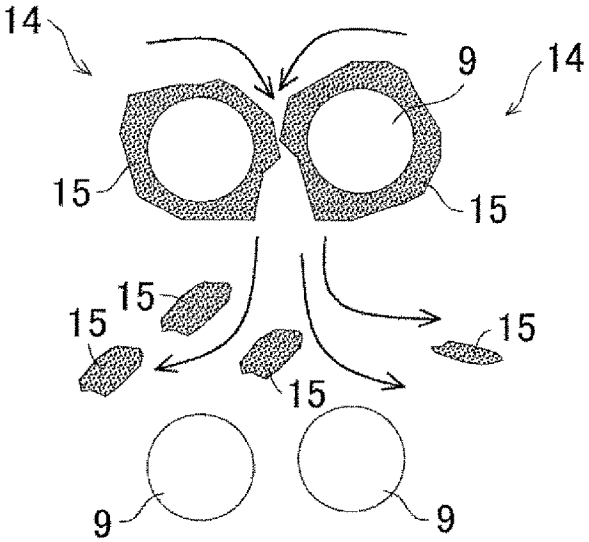
FIG. 9B is a diagram showing an example of a state in which the water glass detaches from the core sand according to the embodiment of the disclosure.
Figure 9A:
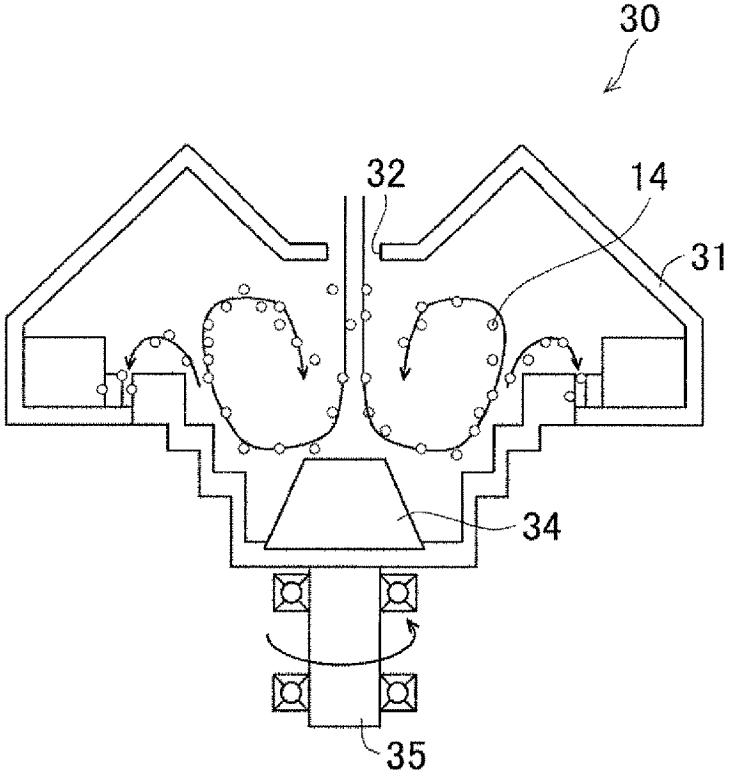
FIG. 9A is a diagram showing a detaching device which detaches the water glass from the core sand in the method of reusing core sand according to the embodiment of the disclosure.

Next, in the detaching step shown in Step S3, the heated granules 14 are caused to collide against each other such that the water glass 15 detaches from the core sand 9. FIG. 9A is a diagram showing a detaching device which detaches the water glass from the core sand in the method of reusing core sand according to the embodiment. FIG. 9B is a diagram showing an example of a state in which the water glass detaches from the core sand of the granules. As shown in FIG. 9A, the detaching device 30 includes a chamber 31, an inlet 32, a rotor 34, and a motor 35. The chamber 31 is provided above the motor 35. The inlet 32 is provided above the chamber 31. The rotor 34 is provided in the chamber 31. The rotor 34 rotates when the motor 35 rotates.

The granules 14 incorporated from the inlet 32 rotates in a vertical direction when the rotor 34 rotates. The rotating speed is 2200 rpm (frequency: 72.0 Hz). As shown in FIG. 9B, in the detaching device 30, the granules 14 are caused to collide against each other such that the active water glass 15 and the inactive water glass 15 adhering to the surface of the core sand 9 are detached from the surface of the core sand 9. The treatment time is, for example, 200 seconds. The amount of the granules 14 treated per batch is, for example, 17.5 kg. Due to the detaching step, the proportion of the inactive water glass 15 and the proportion of the active water glass 15 in the used water glass 15 can be reduced. In the heating step, the water glass 15 is heated and thus is appropriately dried and detaches from the core sand 9 easily.

Figure 10:
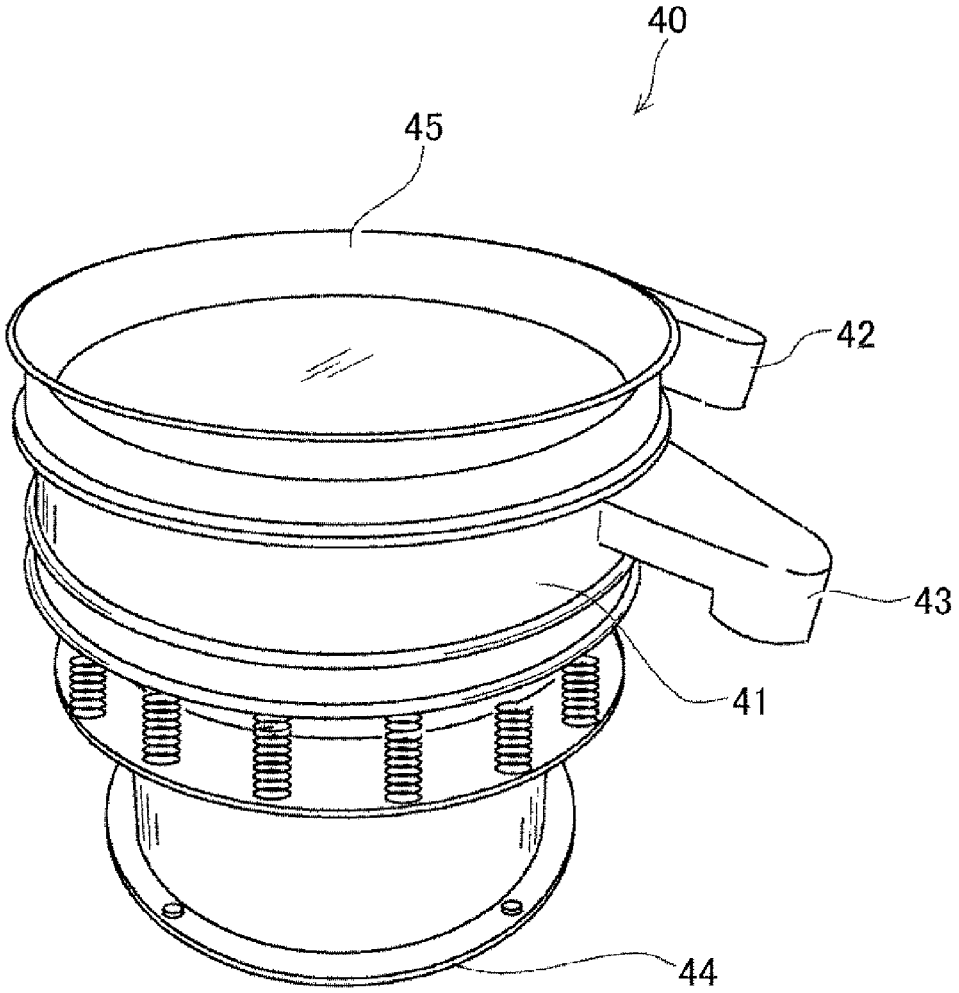
FIG. 10 is a diagram showing a separating and collecting device which separates and collects the core sand in the method of reusing core sand according to the embodiment of the disclosure.

Next, in the separation and collection step shown in Step S4, air is blown into a mixture of the water glass 15 and the core sand 9, which are detached from each other, such that the core sand 9 is separated and collected from the mixture due to a difference in specific gravity between the water glass 15 and the core sand 9. FIG. 10 is a diagram showing a separating and collecting device which separates and collects the core sand in the method of reusing core sand according to the embodiment. As shown in FIG. 10, the separating and collecting device 40 separates and collects the core sand 9 from the mixture of the water glass 15 and the core sand 9 by blowing air thereto. The separating and collecting device 40 includes a chamber 41, an inlet 42, an outlet 43, an air blowing port 44, and an air outlet port 45. A duct (not shown) is provided above the air outlet port 45.

The mixture of the water glass 15 and the core sand 9 is put into the chamber 41 through the inlet 42. The core sand 9 put into the chamber 41 is separated due to a difference in specific gravity by air blown from the air blowing port 44. The water glass 15 having a low specific gravity is blown to the air outlet port 45 along with the air, and the core sand 9 having a high specific gravity is blown to the outlet 43. As a result, the core sand 9 is separated and collected from the outlet 43.

In this way, by treating the used core sand 9 in the crushing step (Step S1), the heating step (Step S2), the detaching step (Step S3), and the separation and collection step (Step S4) in this order, the core sand 9 can be reused to form a core (Step S5). During the formation of a core, the core sand 9 is put into a mold and is solidified by heating to form a core. The heating temperature is, for example, a temperature lower than a casting temperature. As a result, the used core sand can be reused such that the formed core has the same strength as that of a core formed using new core sand.

Next, as shown in Step S6, the formed core is used for casting. For example, the core is used for aluminum casting at a casting temperature of 650° C. to 750° C. Next, as shown in Step S7, a post-treatment is performed. In the post-treatment, the used core is shaken off from a casting formed by casting. Next, in order to reuse the core sand 9, the crushing step of Step S1 is performed.

Figure 11:
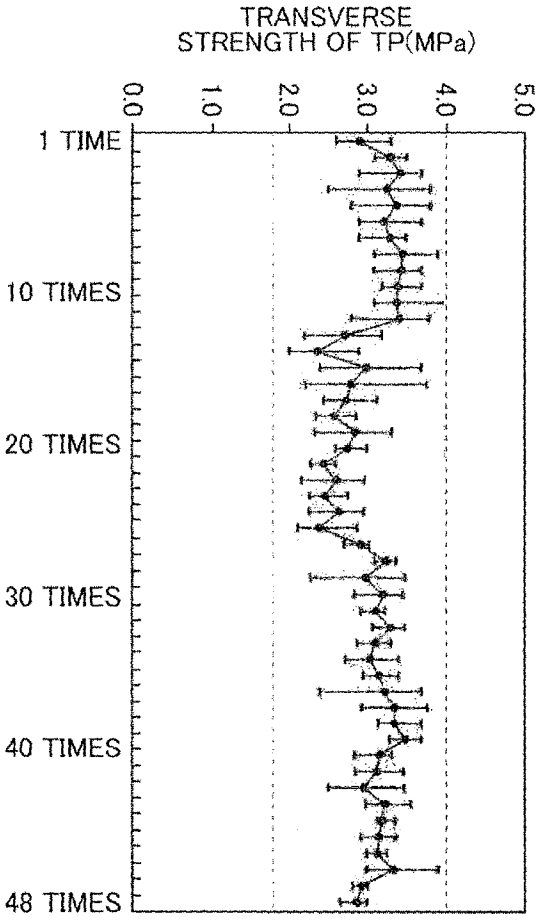
FIG. 11 is a graph showing an example of a strength of a core in the method of reusing core sand according to the embodiment of the disclosure, in which the horizontal axis represents the number of times of reuse and the vertical axis represents a transverse strength of a test piece (TP).

FIG. 11 is a graph showing an example of a strength of a core formed in the method of reusing core sand according to the embodiment, in which the horizontal axis represents the number of times of reuse and the vertical axis represents a transverse strength of a test piece (TP). As shown in FIG. 11, the transverse strength of a core formed using new core sand is 1.8 to 4.0 MPa. Even in a case where the core sand is reused 48 times to form cores, the strengths of the cores is maintained at the same strength as that of the core formed using new core sand.

In the method of reusing core sand according to the embodiment, the granules obtained by crushing the core after casting are heated at a temperature of 300° C. to 550° C. Therefore, the water glass 15 included in the granules 14 is inactivated, and the strength of a core formed reusing the core sand can be improved.

Since even a core in which the water glass 15 is used as a binder can be reused, the manufacturing costs can be reduced.

In the crushing step, the core is crushed into the granules 14. As a result, in the heating step, the granules 14 can be uniformly heated. Further, in the detaching step, the water glass 15 can be uniformly detached from the core sand 9.

In the heating step, it is preferable that, due to the heating, the amount of the water-soluble water glass 15 is adjusted to be smaller than the amount of the water-insoluble water glass 15 in the water glass 15 included in the granules 14. In particular, it is preferable that the amount of the water-soluble water glass 15 is adjusted to be 0.2% or lower with respect to the amount of the granules 14. With the above-described configuration, the inhibition of the hardening of the water glass 15 by sodium ions can be reduced, and the strength of a core formed by reusing the core sand can be further improved.

In the heating step, the water glass 15 can be appropriately dried. As a result, the water glass 15 can be easily detached from the core sand 9. In the detaching step, not only the water-soluble water glass 15 but also the water-insoluble water glass 15 can be detached from the core sand 9. Therefore, in the separation and collection step, the amount of the used water glass 15 included in the core sand 9 can be reduced.

Hereinabove, the embodiment of the method of reusing the core sand 9 according to the disclosure has been described. However, the disclosure is not limited to the above-described configuration, and various modifications can be made.

For example, in the embodiment, the method of reusing core sand in which the water glass 15 is used as a binder has been described. However, this reuse method is applicable to not only sand used for forming a core but also sand used for casting.

What is claimed is:

1. A method of reusing core sand comprising:

crushing a core used for casting into granules;

heating the granules at a temperature of 300° C. to 550° C.;

after heating the granules, cooling the granules to 100° C. or lower;

after cooling the granules, causing the granules to collide against each other such that water glass used as a binder detaches from the core sand; and blowing air into a mixture of the water glass and the core sand such that the core sand is separated and collected from the mixture due to a difference in specific gravity between the water glass and the core sand, the water glass and the core sand being detached from each other.

2. The method of reusing core sand according to claim 1, wherein due to the heating, an amount of water-soluble water glass is adjusted to be smaller than an amount of water-insoluble water glass in the water glass included in the granules.

3. The method of reusing core sand according to claim 1, wherein due to the heating, a ratio of the mass of water-soluble water glass in the water glass included in the granules to the mass of the granules is adjusted to be 0.2% or lower.

4. The method of reusing core sand according to claim 1, wherein the collision of granules is caused by circulating the granules.

5. The method of reusing core sand according to claim 4, wherein the circulation of the granules is caused by rotating a rotor.

6. The method of reusing core sand according to claim 5, wherein the circulation of granules occurs in a detaching device comprising the rotor, a chamber, an inlet, and a motor.

* * * * *